US005161399A

United States Patent [19]

Piguet et al.

[11] Patent Number: 5,161,399

[45] Date of Patent: Nov. 10, 1992

[54] DEVICE FOR STRAIGHTENING A WIRE

[75] Inventors: Pierre-Louis Piguet, La Chaux-de-Fonds; Peter Meier, Colombier, both of Switzerland

[73] Assignee: ESCO S.A., Switzerland

[21] Appl. No.: 773,599

[22] PCT Filed: Mar. 21, 1991

[86] PCT No.: PCT/CH91/00068

§ 371 Date: Nov. 15, 1991

§ 102(e) Date: Nov. 15, 1991

[87] PCT Pub. No.: WO91/14522

PCT Pub. Date: Oct. 3, 1991

[30] Foreign Application Priority Data

Mar. 26, 1990 [FR] France ..... 90 03994

[51] Int. Cl.[5] ..... B21F 1/02

[52] U.S. Cl. ..... 72/79; 140/140

[58] Field of Search ..... 72/79; 140/139, 140, 140/147

[56] References Cited

U.S. PATENT DOCUMENTS 1,847,454 3/1932 Webb .
2,172,134 9/1939 Wright .
3,277,682 10/1966 Kestner ..... 140/147

FOREIGN PATENT DOCUMENTS 1034576 7/1958 Fed. Rep. of Germany .
2707970 3/1979 Fed. Rep. of Germany .
2312314 12/1976 France .

*Primary Examiner*—Lowell A. Larson
*Attorney, Agent, or Firm*—Davis, Bujold & Streck

[57] ABSTRACT

A device for straightening a rigid wire delivered in coil form for supplying a metal-working machine is compact and easy to control. The wire is stationary in an axial conduit of a rotor supported on a carriage (B) which is moved axially by means of a first hydraulic jack (13). The rotor carries the wire by stationary guides and a central guide which is moved radially (C) between a centered position and an excentric position by means of a second hydraulic jack (62) while the rotor rotates and the carriage advances. The hydraulic fluid collected at the output (71) of the first jack is transmitted directly to an input (66 or 67) of the second jack (62) so as to actuate it at a speed proportional to that of the first.

10 Claims, 3 Drawing Sheets

DEVICE FOR STRAIGHTENING A WIRE

The present invention concerns a device for straightening a wire, particularly at the inlet of a metal working apparatus, comprising a frame to which are attached means for holding the wire, a rotor connected to continuous rotation drive means, said rotor having an axial conduit which is traversed longitudinally by the wire, a backward and forward drive means designed to produce relative longitudinal movement between the rotor and the wire, a movable central guide traversed by the wire and attached to the rotor so as to be transversely displaceable in relation to the axial conduit between a generally centered position and an eccentric position, means for controlling eccentric movement designed to displace the central guide by means of fluid pressure during rotor rotation, and stationary guides traversed by the wire and disposed in the axial conduit on either side of the central guide.

Metal working machines designed for manufacturing small pieces, especially for screw cutting, are usually supplied with material in the form of a wire reel which is unrolled to penetrate the machine longitudinally. However, preliminary straightening of the wire is necessary to ensure that the final product is satisfactory. Generally this is accomplished by a straightening device installed at the input of the machine and operating intermittently, each time the wire advances, in order to make a new piece. It should be noted that the term "wire" as used here may designate a metal element which may or may not be circular, is relatively rigid, and has transverse dimensions usually of the order of several millimeters and as large as approximately 10 to 12 mm.

The invention concerns a rotary type straightener in which the wire is disposed generally along the axle of a rotor usually having five guides, that is, one central guide which is transversely movable so as to deform the wire and two pairs of auxiliary stationary guides on either side of the central guide. Straightening is achieved in known manner by a combination of eccentric positioning of the central guide, rotation and relative displacement of the rotor in relation to the wire, or the reverse. These movements provoke inflection with spiral propagation in the wire, thereby deforming it beyond the elastic limit to the extent that it reverts to rectilinear form by elasticity. Naturally, the amplitude of eccentric displacement and the distance between guides must be adapted to the dimensions and mechanical characteristics of the various wires to be treated.

Known devices for applying this technique present a certain number of disadvantages from the point of view of construction and use. The need to progressively displace the central guide to an eccentric position in relation to the wire during the course of rotor displacement requires complicated mechanisms which are usually controlled by cams actuated by a cam shaft associated with the metal working apparatus. For this reason, the device is fairly cumbersome and the rotor, in particular, is much longer than the distance occupied by the guides because of the space necessary for the control mechanism between the two rotor bearings. Moreover, this mechanism is relatively complicated, with a large number of belts, levers, etc., therefore quite costly, and poses problems of equilibrium and play which affect its precision. In addition, current devices require precise adjustment of the stationary guides which can only be done when they are stopped, therefore, they take a rather long time to adjust.

Patent Application FR-A-2 312 314 (=DE-A-2 523 831) describes a stationary straightening device continuously traversed by the wire to be straightened and wherein eccentric positioning of the central guide is controlled by a bushing axially slidable on the rotor, said bushing having axially inclined surfaces in contact with a support on the central guide. This support slides radially when the bushing is radially displaced by a control mechanism. Application DE-A-2 707 970 describes a perfected embodiment of this device in which said drive mechanism is actuated by a hydraulic jack whie the rotor turns, particularly to replace the guide in centered position if the wire stops advancing for any reason. However, this pneumatic control is not provided for generating working cycles in which the central guide is progressively displaced. Actually, this device is designed to work continuously and not in cycles.

The goal of the present invention is to provide a device which will substantially eliminate the difficulties described above, thanks to simple, compact construction which allows the central guide to be easily and precisely controlled.

To accomplish this the invention provides a device of the type described in the preamble, characterized in that the backward and forward drive means is a first hydraulic jack, and in that the means for eccentric displacement comprise a second hydraulic jack hydraulically connected to the first jack so that it functions at a speed dependent upon that of the first jack.

In a preferred embodiment the rotor is connected by bearings to a carriage on the frame which is movable in the longitudinal direction of the wire and connected to the first jack.

When the central guide on the device comprises a support radially slidable within the rotor and with a contact means at the end farthest from the rotor axle, and the means for controlling eccentric displacement comprise a slidable bushing atthed to the periphery of the rotor so as to turn with it and having an axially inclined contact surface, in contact with said contact means, said inclined contact surface may be formed of a detachable element affixed to the slidable bushing and covering a radial groove to which the sliding support of the central guide is attached. Said contact means on the slidable support preferably comprises a rotary pulley on the inclined contact surface, and the end opposite said support rests on a spring tending to keep the pulley in place on said surface.

In a preferred embodiment, the means controlling eccentric displacement comprise a rotating slidable block attached around the slidable bushing by means of at least one bearing, said block being connected to the second jack and cooperating with stops defining the positions of the central guide.

On each side of the central guide the rotor may have an axial groove in which a tubular sleeve containing at least two stationary guides may be detachably connected, starting at a corresponding rotor extremity. Each guide preferably comprises a guide cylinder attached inside a bearing, each of the tubular sleeves has a cylindrical axial groove and the bearings on the stationary guides are inserted into said sleeve groove and are axially maintained in respective positions selected by means of interchangeable tubular cross-pieces.

In an advantageous form of the invention, the hydraulic jacks are two-way jacks and said second jack controlling the central guide comprises two opposite chambers which are alternately connected by means of an electrically controlled inversion valve, to an output of the first jack and to a fluid return conduit, so that the speeds of the two jacks are proportionate to each other. The output of the first jack may be connected to a return conduit through a spring valve for passsage of fluid when the course of the second jack is blocked by a stop. The device preferably comprises means for measuring rotor speed and for regulating the flow of liquid actuating the first jack as a function of rotor speed.

The present invention will be better understood with the help of the following description of a preferred embodiment and with reference to the attached drawings, wherein.

Figure 1:
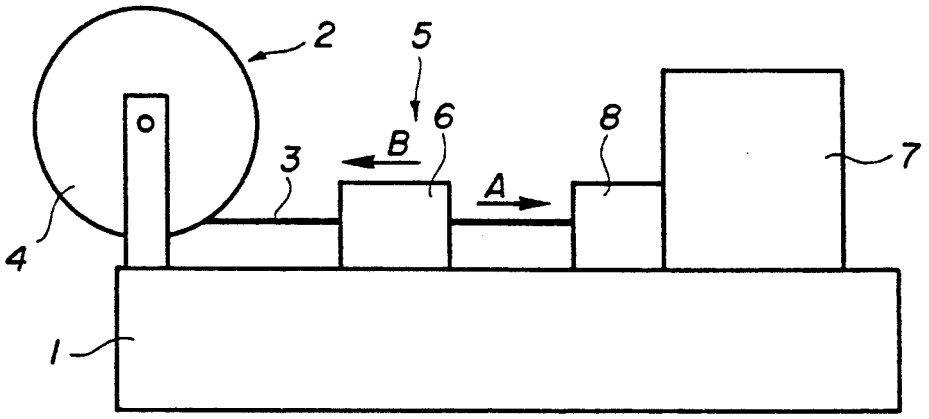
FIG. 1 is a schematic lateral view of an installation comprising a straightening device according to the invention associated with a metal working apparatus for the wire straightened by said device.

With reference to FIG. 1, a common framework supports a device 2 for unrolling a wire 3 stored on a reel 4, a wire straightening device 5 according to the invention provided with a carriage 6 which moves backward and forward along the wire, and a metal working apparatus 7 such as a screw cutting machine working on successive portions of wire 3 and provided with a device 8 for intermittently maintaining and advancing wire 3 in the direction of arrow A. The straightening device 5 straightens a predetermined length of wire 3 while the latter is held in stopped position by device 8, for example immediately after an advancing operation. Straightening takes place during displacement of carriage 6 in the direction of arrow B.

Figure 2:
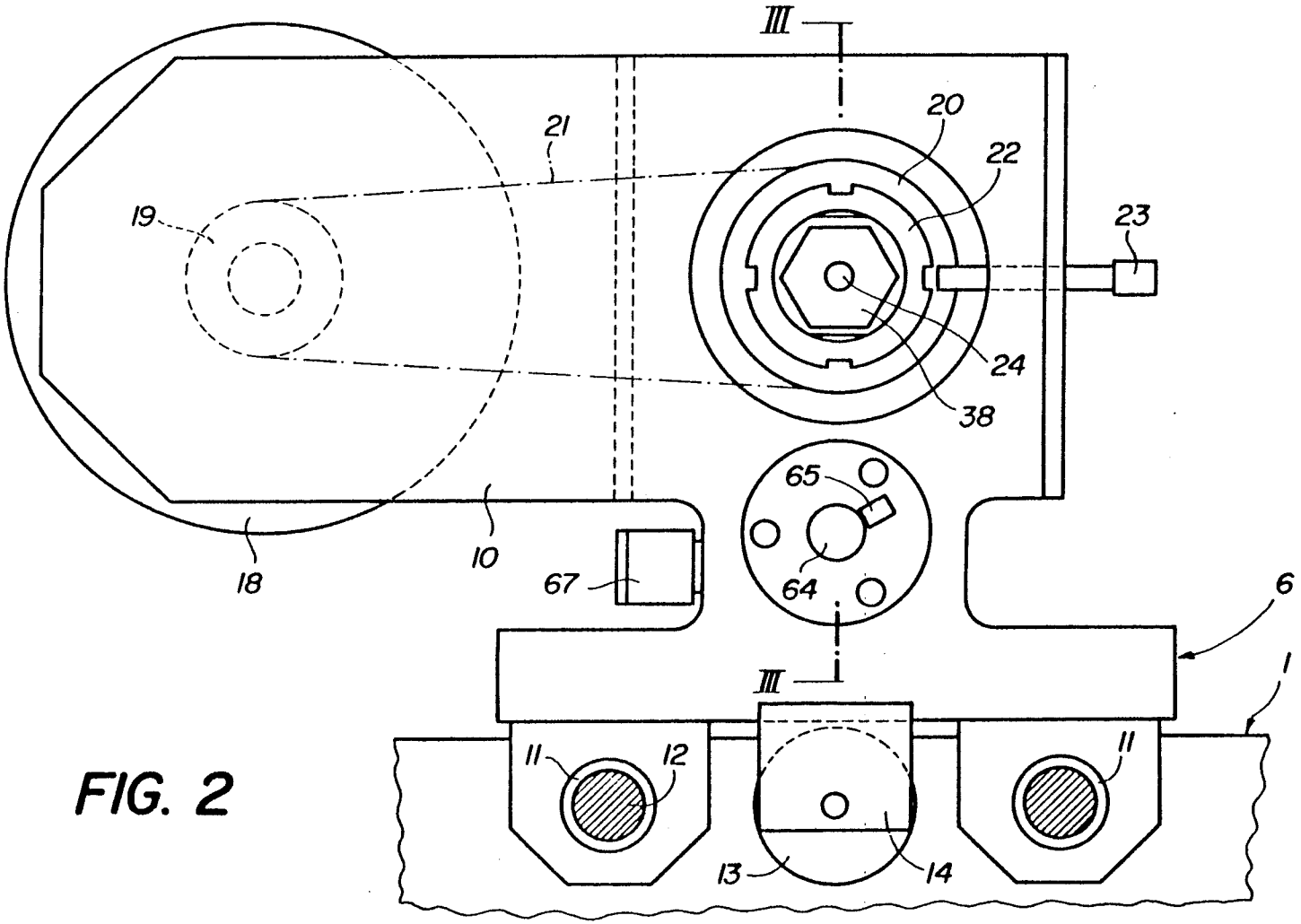
FIG. 2 is a rear view of the carriage of the straightening device in the direction of wire advancement.
Figure 3:
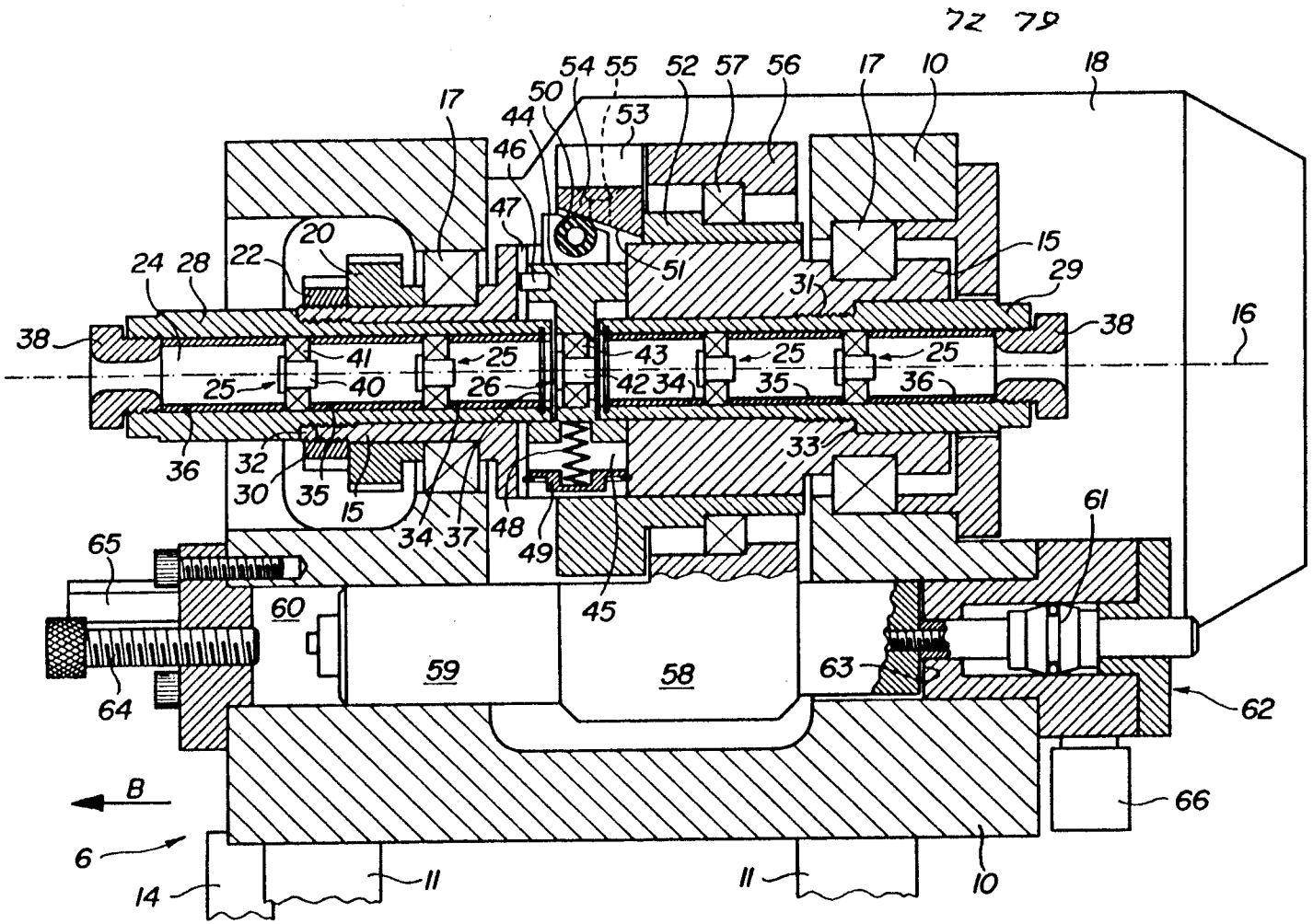
FIG. 3 is an axial cross-section taken along line III—III of FIG. 2.

FIGS. 2 and 3 show the principal portion of the straightening device 5, that is, the portion supported by carriage 6. However, in order to clarify the drawing, certain elements such as the electrical and hydraulic connections are not shown in detail. Carriage 6 comprises a frame 10 with slidable bearings 11 which can move backward and forward along slides 12 affixed to frame 1, by means of a two-way hydraulic advance jack 13 attacking a contact stud 14 affixed to frame 10. The frame comprises a rotor 15 with axle 16, two bearings 17 and an electric motor 18 for continuously rotating rotor 15 by means of transmission guide wheels 19, 20 and notched belt 21. Wheel 20 is affixed to rotor 15 by means of a key and a wire ring 22 with notches cooperating with detector 23 to furnish a signal showing the rotation speed of rotor 15.

As is shown in FIG. 3, rotor 15 surrounds an axial conduit 24 within which wire 3 (not shown in this drawing) is guided along axle 16 by means of four stationary guides 25 and transversely movable central guide 26. In actuality, these various guides should be spaced apart from each other by a distance corresponding to approximately ten times the wire diameter. Stationary guides 25 are attached two by two in a posterior sleeve 28 and an interior sleeve 29 which are easily removed, as they are inserted in an axial groove on the rotor and screwed into it by screws 30, 31 and shoulder stops 32, 33. Each sleeve 28, 29 has a cylindrical axial groove in which guides 25 are braced by means of tubular cross pieces 34 through 36 between a stop ring 37 and a screw 38 open at the center. Each guide 25 comprises a guide cylinder 40 with an opening appropriate for the wire diameter. This cylinder is attached to the interior ring of a bearing 41, the exterior ring of which is adapted to the corresponding sleeve 28, 29 and clamped between the cross pieces.

Thus, any change in position or type of stationary guides 25 in the straightening device may be made very quickly, since it is only necessary to unscrew sleeves 28 and 29 and replace them with two other sleeves previously equipped with the appropriate guides. In this way all the operations of positioning and centering the stationary guides can take place outside the rotor.

Movable guide 26 also comprises a straightening cylinder 42 traversed by the wire and a bearing 43 affixed in a support 44 which is slidably attached within radial groove 45 on the rotor, where it is guided by means of a peg 46 and a slot 47. Support 44 is pushed toward the centered position of guide 26 by a spring 48 contacting a cover 49. This spring essentially plays the role of stopping, since while the rotor is rotating, support 44 is urged in the same direction by centrifugal force. On the side opposite the spring, support 44 is provided with a pulley 50 contacting axially inclined surface 51, forming a movable ramp whose axial displacements control the radial displacements of central guide 26 between adjustable centered and eccentric positions.

A rotatable cylindrical bushing 52 with a neck 53 is attached so that it slides axially on the exterior cylindrical surface of rotor 15, where it is guided by a key, not shown. Neck 53 is interrupted across from the radial groove 45 on the rotor for installation and removal of central guide 26 and its support, as well as for attaching a corner shaped element 54 with an inclined surface 51. This element is attached to neck 53 by two lateral bolts 55 allowing it to be easily removed for chaning guide 26. A slidable block 56 surrounds rotatable bushing 52, to which it is attached by means of a bearing 57 allowing it to exert an axial push on the bushing without turning with it. Block 56 has a lower projection 58 in which is affixed a guide axle 59 attached to a longitudinal slide 60 inside the carriage. One end of axle 59 is integral with piston 61 of a two-way hydraulic jack 62 called the plunge jack, as it controls the eccentric displacement of central guide 26. One end 63 of the body of jack 62 forms a stop for axle 59, said stop defining the centered position for guide 26. The other end of axle 59 cooperates with an adjustable stop formed by a bolt 64, next to which the carriage holds a gradated measurement device 65. This allows the maximum eccentric position of guide 26 to be easily adjusted without necessitating a stop on the rotor. The fact that stops 63 and 64 act directly at the level of the plunge jack 62 is advantageous because it eliminates the need for a stop to expend any effort or to arrange the mechanical elements installed on the rotor. Moreover, stop 64 can be adjusted while the rotor is turning. In FIGS. 2 and 3, the input and output connections 66, 67 on the plunge jack 62 are also visible, which are for piping the hydraulic conduits, the latter being flexible because of the path of carriage 6, usually of the order of 100 mm.

If inclined surface 51 is plane or conical on axis 16, radial displacement of central guide 26 is linear in relation to the course of plunge jack 62. The relationship between these two displacements is defined by the angle of surface 51, thereby allowing very precise control and adjustment of the extreme positions of the guide.

In general, rotor 15 turns continuously and at a constant speed during the operations of finishing, forward movement and wire straightening. Straightening takes place while carriage 6 is moving forward in the direction of arrow B. During this time, plunge jack 62 is actuated so that it progressively displaces slidable block 56 and rotatable bushing 52 toward the left, from the resting position in FIG. 3, to lower central guide 26 to its eccentric position defined by stop 64. The unit remains in this position for a few instants, then jack 62 is actuated in the other direction so as to progressively place central guide 26 in the centered position before the carriage completes its course. To avoid breaking the wire and to obtain appropriate straightening, it is important that the plunging motion of central guide 26 be progressive and synchronized with its axial movement in relation to the wire, that is, with the movement of the carriage influenced by advance jack 13. Hydraulic control resolves this problem simply.

Figure 4:
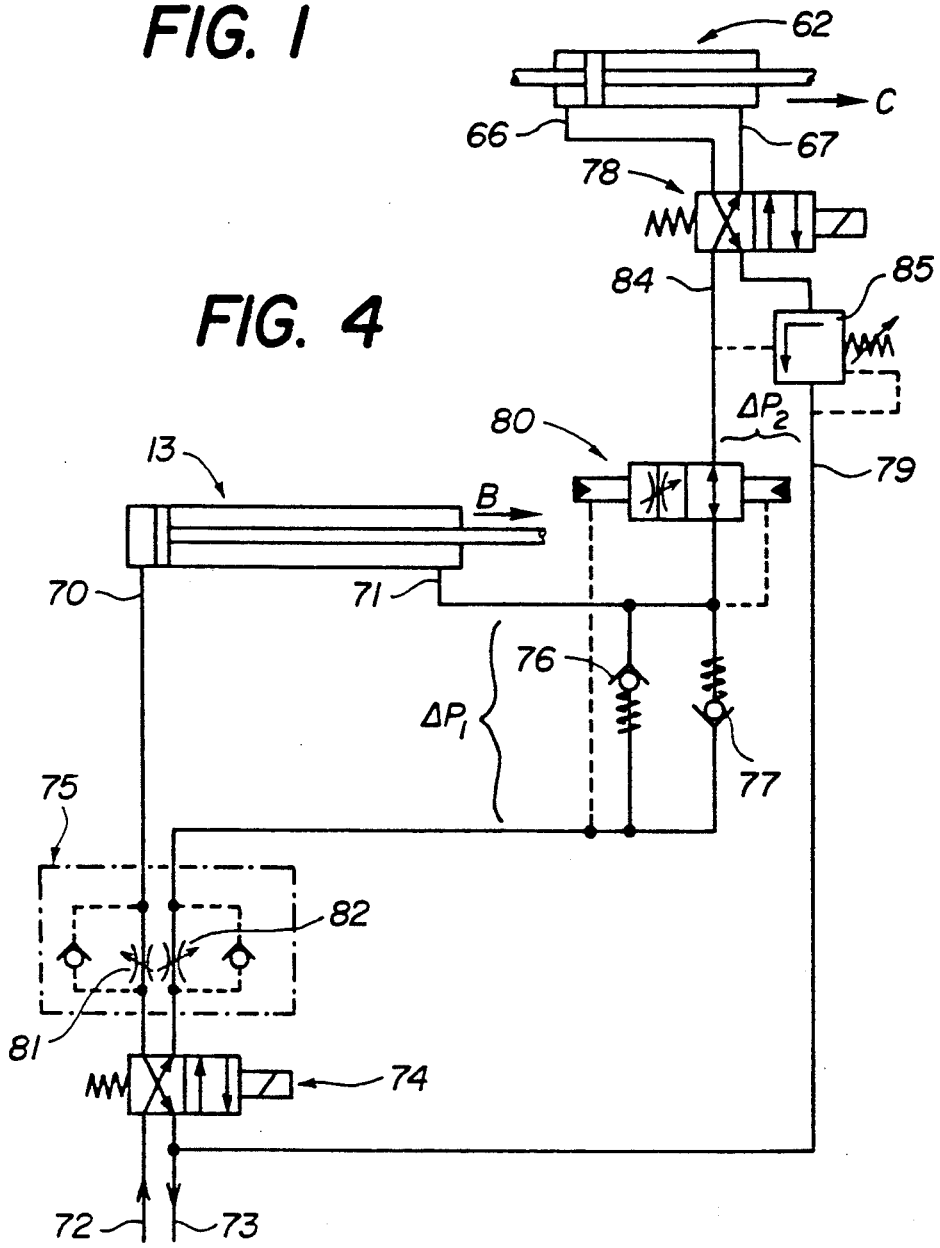
FIG. 4 is a schematic representation of the hydraulic circuit of the device.

The diagram in FIG. 4 shows how advance jack 13 and plunge jack 62 are hydraulically connected so that they function at synchronized speeds during one wire straightening cycle. Advance jack 13 has input and output connections 70 and 71 for axial displacement of carriage 6; these are connected to a pressurized fluid supply conduit 72 and to fluid return conduit 73, through a solenoid reversal valve 74, a flow limiter 75 and, near connection 71 on jack 13, two spring valves 76 and 77 attached in opposition and adjusted to a pressure corresponding to approximately half the pressure supplying conduit 72.

The input and output connections 66 and 67 of plunge jack 62 are connected, through a solenoid reversal valve 78, on one side to return conduit 79 and on the other to connection 71 on jack 13 through a valve 80 guided by the respective presssures prevailing on one side and the other of valves 76 and 77. During normal operation of the device, this valve plays no role and remains in the position shown.

The hydraulic diagram shows the various devices in resting position before a wire straightening cycle. In regulator 75 a narrowed portion 81 connected to jack inlet 70 is regulated as a function of rotor speed in order to adjust jack displacement speed, while the other narrowed portion 82 is 100% open. Jacks 13 and 62 are stopped (on the left in the diagram of FIG. 4). To begin the wire straightening cycle and move carriage 6 in direction B, solenoid reversal valve 74 is activated to the extent that some pressurized fluid enters jack 13 through connection 70 and some fluid exits it through connection 71. After activation of solenoid reversal valve 78, this exiting fluid is transmitted to input 66 of plunge jack 62 and therefore activates it in the direction of arrow C at a speed proportionate to that of jack 13, that is, the central guide is linearly displaced in an eccentric position in relation to the movement of carriage 6. When plunge jack 62 reaches the stopped position (stop 64, FIG. 3), the fluid exiting jack 13 returns through valve 76.

Before the carriage completes its course, the central guide is returned to its centered position by deactivating valve 78 so that the fluid leaving connection 71 in jack 13 enters connection 67 in jack 62 and activates the latter in the opposite direction from C, always at a speed proportionate to that of jack 13. Then, to replace the carriage in its starting position, valve 74 is deactivated so that it reverts to the position shown in the drawing and the pressurized fluid is transmitted to connection 71 in jack 13. Since jack 62 has already reached the stop, it is not displaced further and central guide 26 remains in the centered position. Narrowed portion 82 allows adjustment of the return speed of carriage 6.

During manual regulation of the straightening parameters, the carriage and advance jack 13 are at rest, so that valve 78 is supplied directly with pressure at its input 84. Downward motion of the central guide can therefore be controlled just as if the two jacks 13 and 62 were disconnected. However, downward speed should not be too high as the wire would be poorly straightened. This is why valve 80 is provided, which is activated by the pressure at the output of narrowed portion 82, so as to reduce the flow of fluid. During normal functioning, the valve is deactivated by the pressure forced through connection 71 of jack 13.

The effort necessary to displace the central guide eccentrically varies greatly as a function of the nature and size of the material to be straightened. Furthermore, the choice of opening pressure $\Delta$ P1 for the anti-return valve 76 should allow the most resistant material to be straightened.

As a result, when straightening smaller size material, the pressure differential necessary between points 84 and 73 to activate plunge jack 62 would be considerably lower than the value of that regulated on valve 76. For this reason, when jack 62 reaches the stopped position, pressure at connection 71 will increase suddenly to a level allowing valve 76 to open, which will cause a sudden jerk. This is avoided by the use of a pressure differential regulator 85 for adjusting the pressure differential $\Delta$ P2 between points 73 and 84 to a value close to but always less than value $\Delta$ P1 regulated on valve 76. Pressure at 71 is thus maintained nearly constant, whatever the resistance offered by the material during straightening. This allows the device to work on a vast array of materials and sizes.

The preceding description shows how the invention provides a straightening device of relatively simple construction and reduced size by virtue of judicious arrangement of its parts. In addition, the hydraulic control is very simple so that forward displacement and downward motion of the central guide are easily synchronized for optimal wire straightening. Finally, the operations of preparing and adjusting the device for straightening a given type of wire are much simpler than in known devices, as the need to center the material manually is eliminated, and the stationary guides may be prepared outside the machine.

The present invention is not limited to the exemplary embodiment described above, but may extend to any modification or variation obvious to one skilled in the art. In particular, the same principles of construction and function are applicable to a device where the wire itself is longitudinally displaced during the straightening operation by means of a hydraulic jack replacing jack 13, while the rotor remains in place.

We claim:

1. Device for straightening a wire, especially wire at the inlet of a machine finishing apparatus, comprising:

a frame (1) to which means (8) for maintaining the wire are attached, a rotor (15) attached to means for driving it in continuous rotation, said rotor having an axial conduit (24) longitudinally traversed by the wire, a means for producing backward and forward motion designed to cause relative longitudinal movement between the rotor (15) and the wire (3), a movable central guide (26) traversed by the wire and attached to the rotor so as to be transversely displaced in relation to the axial conduit between a generally centered and an eccentric position, means for controlling eccentric positioning desinged to displace the central guide (26) by means of fluid pressure during rotor rotation, and stationary guides (25) traversed by the wire and disposed in the axial conduit on either side of the central guide, characterized in that the means for producing backward and forward motion comprises a first hydraulic jack (13), and in that the means for controlling eccentric positioning comprises a second hydraulic jack (62) hydraulically connected to the first jack (13) so that its functioning speed depends upon that of the first jack.

2. Device according to claim 1, characterized in that the rotor (15) is attached by bearings (17) to a carriage (6) movable on the frame in the longitudinal direction of the wire (3) and attached to the first jack (13).

3. Device according to claim 1, in which the central guide (26) comprises a support (44) radially slidable within the rotor and with a contact means (50) at the end fartherst from the axle (16) of the rotor, and in which the means for controlling eccentric positioning comprises a slidable bushing (52) attached to the periphery of the rotor so that it turns with it, and having an axially inclined contact surface (51) in contact with said contact means, characterized in that said axially inclined contact surface (51) is formed of a removable element (54) affixed to the slidable bushing (12) and which covers a radial groove (45) to which slidable support (44) of the central guide is attached.

4. Device according to claim 3, characterized in that said contact means on the slidable support (44) comprises a pulley (50) rotating upon the inclined contact surface, and in that the end opposite said support (44) is in contact with a spring (48) tending to maintain the pulley against said contact surface.

5. Device according to claim 3, characterized in that the means for controlling eccentric positioning comprise a rotatable slidable block (56) attached around the slidable bushing by means of a bearing (57), said block being connected to the second jack (62) and cooperating with stops (63, 64) defining said central guide positions.

6. Device according to claim 1, characterized in that on each side of the central guide (26), the rotor (15) has an axial groove within which a tubular sleeve (28, 29) containing at least two stationary guides (25) is removably attached, beginning at a corresponding rotor extremity.

7. Device according to claim 6, characterized in that each guide (25, 26) comprises a guide cylinder (40, 42) attached inside a bearing (41, 43), in that each tublar sleeve (28, 29) comprises a cylindrical axial groove, and in that the bearings (41) on the stationary guides are inserted into said sleeve groove and are axially maintained in respective positions chosen by means of interchangeable tubular cross pieces (34, 35, 36).

8. Device according to claim 1, characterized in that the hydraulic jacks (13, 62) are two-way jacks and in that said second jack (62) controlling the central guide has two opposite chambers which are alternatively connected by means of an electrically controlled solenoid reversal valve (78) to the output (71) of the first jack (13) and to a fluid return conduit (79), so that the speed of each jack is proportionate to the other.

9. Device according to claim 8, characterized in that said output (71) of the first jack is connected to a return conduit (73) through a spring valve (76) allowing passage of the fluid when the course of the second jack (62) is blocked by a stop (64).

10. Device according to claim 8, characterized in that it comprises means (23, 81) for measuring the speed of the rotor (15) and to regulate the flow of fluid actuating the first jack (13) as a function of rotor speed.

* * * * *